US009357299B2

(12) United States Patent
Kwong

(10) Patent No.: US 9,357,299 B2
(45) Date of Patent: May 31, 2016

(54) ACTIVE PROTECTION FOR ACOUSTIC DEVICE

(71) Applicant: Apple Inc., Cupertino, CA (US)

(72) Inventor: Kelvin Kwong, San Jose, CA (US)

(73) Assignee: APPLE INC., Cupertino, CA (US)

( * ) Notice: Subject to any disclaimer, the term of this patent is extended or adjusted under 35 U.S.C. 154(b) by 365 days.

(21) Appl. No.: 13/679,721

(22) Filed: Nov. 16, 2012

(65) Prior Publication Data

US 2014/0140558 A1 May 22, 2014

(51) Int. Cl.
*H04R 25/00* (2006.01)
*H04R 3/00* (2006.01)

(52) U.S. Cl.
CPC ..... *H04R 3/007* (2013.01); *H04R 2499/11* (2013.01)

(58) Field of Classification Search
CPC ..... H04R 3/007; H04R 2499/11; H04R 2410/07; H04M 1/03; H04M 1/035
USPC ..... 381/55, 189, 345
See application file for complete search history.

(56) References Cited

U.S. PATENT DOCUMENTS 1,646,628 A * 10/1927 Nolen ..... H04R 1/225 381/189
1,893,291 A 1/1933 Kwartin
2,325,688 A * 7/1943 Landis ..... H04R 1/083 181/171
3,414,689 A * 12/1968 Gummel ..... H04M 1/03 257/417
4,068,103 A 1/1978 King et al.
4,081,631 A 3/1978 Feder
4,089,576 A 5/1978 Barchet
4,245,642 A 1/1981 Skubitz et al.
4,466,441 A 8/1984 Skubitz et al.
4,658,425 A 4/1987 Julstrom
5,106,318 A 4/1992 Endo et al.
5,293,002 A 3/1994 Grenet et al.
5,335,011 A 8/1994 Addeo et al.
5,406,038 A 4/1995 Reiff et al.
5,521,886 A 5/1996 Hirosawa et al.
5,570,324 A 10/1996 Geil
5,604,329 A 2/1997 Kressner et al.
5,619,583 A 4/1997 Page et al.
5,733,153 A 3/1998 Takahashi et al.

(Continued)

FOREIGN PATENT DOCUMENTS

EP 2094032 8/2009
GB 2310559 8/1997

(Continued)

OTHER PUBLICATIONS

Baechtle et al., "Adjustable Audio Indicator," IBM, 2 pages, Jul. 1, 1984.

(Continued)

*Primary Examiner* — Matthew Eason
(74) *Attorney, Agent, or Firm* — Brownstein Hyatt Farber Schreck, LLP

(57) ABSTRACT

A device comprises a housing, an acoustic component coupled to an exterior of the device through an acoustic passage in the housing, and an actuated mechanism operable to close the acoustic passage between the acoustic component and the housing. The actuated mechanism is operable to close the acoustic passage in response to a control signal, where the control signal is indicative of a pressure differential transmittable from the exterior of the device through the acoustic passage to the acoustic component.

20 Claims, 7 Drawing Sheets

(56) References Cited

U.S. PATENT DOCUMENTS

| | | | |
|---|---|---|---|
| 5,879,598 | A | 3/1999 | McGrane |
| 6,036,554 | A | 3/2000 | Koeda et al. |
| 6,073,033 | A | 6/2000 | Campo |
| 6,129,582 | A | 10/2000 | Wilhite et al. |
| 6,151,401 | A | 11/2000 | Annaratone |
| 6,154,551 | A | 11/2000 | Frenkel |
| 6,192,253 | B1 | 2/2001 | Charlier et al. |
| 6,317,237 | B1 | 11/2001 | Nakao et al. |
| 6,400,825 | B1 | 6/2002 | Miyamoto et al. |
| 6,553,126 | B2 | 4/2003 | Han et al. |
| 6,700,987 | B2 | 3/2004 | Kuze et al. |
| 6,813,218 | B1 | 11/2004 | Antonelli et al. |
| 6,829,018 | B2 | 12/2004 | Lin et al. |
| 6,882,335 | B2 | 4/2005 | Saarinen |
| 6,892,850 | B2 | 5/2005 | Suzuki et al. |
| 6,934,394 | B1 | 8/2005 | Anderson |
| 7,003,099 | B1 | 2/2006 | Zhang et al. |
| 7,082,322 | B2 | 7/2006 | Harano |
| 7,116,795 | B2 | 10/2006 | Tuason et al. |
| 7,154,526 | B2 | 12/2006 | Foote et al. |
| 7,158,647 | B2 | 1/2007 | Azima et al. |
| 7,263,373 | B2 | 8/2007 | Mattisson |
| 7,266,189 | B1 | 9/2007 | Day |
| 7,362,877 | B2 | 4/2008 | Honda et al. |
| 7,378,963 | B1 | 5/2008 | Begault et al. |
| 7,527,523 | B2 | 5/2009 | Yohn et al. |
| 7,536,029 | B2 | 5/2009 | Choi et al. |
| 7,570,772 | B2 | 8/2009 | Sorensen et al. |
| 7,679,923 | B2 | 3/2010 | Inagaki et al. |
| 7,792,320 | B2 | 9/2010 | Proni |
| 7,867,001 | B2 | 1/2011 | Ambo et al. |
| 7,878,869 | B2 | 2/2011 | Murano et al. |
| 7,903,061 | B2 | 3/2011 | Zhang et al. |
| 7,912,242 | B2 | 3/2011 | Hikichi |
| 7,966,785 | B2 | 6/2011 | Zadesky et al. |
| 8,031,853 | B2 | 10/2011 | Bathurst et al. |
| 8,055,003 | B2 | 11/2011 | Mittleman et al. |
| 8,116,505 | B2 | 2/2012 | Kawasaki-Hedges et al. |
| 8,116,506 | B2 | 2/2012 | Kuroda et al. |
| 8,204,266 | B2 | 6/2012 | Munoz et al. |
| 8,218,397 | B2 | 7/2012 | Chan |
| 8,226,446 | B2 | 7/2012 | Kondo et al. |
| 8,264,777 | B2 | 9/2012 | Skipor et al. |
| 8,340,312 | B2 | 12/2012 | Johnson et al. |
| 8,409,417 | B2 | 4/2013 | Wu |
| 8,417,298 | B2 | 4/2013 | Mittleman et al. |
| 8,447,054 | B2 | 5/2013 | Bharatan et al. |
| 8,452,037 | B2 | 5/2013 | Filson et al. |
| 8,488,817 | B2 | 7/2013 | Mittleman et al. |
| 8,560,309 | B2 | 10/2013 | Pance et al. |
| 8,574,004 | B1 | 11/2013 | Tarchinski et al. |
| 8,620,162 | B2 | 12/2013 | Mittleman |
| 8,632,670 | B2 | 1/2014 | Garimella et al. |
| 2004/0203520 | A1 | 10/2004 | Schirtzinger et al. |
| 2005/0041825 | A1* | 2/2005 | Rasmussen ..... H04R 25/402 381/317 |
| 2005/0271216 | A1 | 12/2005 | Lashkari |
| 2006/0072248 | A1 | 4/2006 | Watanabe et al. |
| 2008/0204379 | A1 | 8/2008 | Perez-Noguera |
| 2008/0292112 | A1 | 11/2008 | Valenzuela et al. |
| 2008/0310663 | A1 | 12/2008 | Shirasaka et al. |
| 2009/0274315 | A1 | 11/2009 | Carnes et al. |
| 2010/0062627 | A1 | 3/2010 | Ambo et al. |
| 2010/0172531 | A1* | 7/2010 | Burns ..... H04R 1/326 381/345 |
| 2011/0002487 | A1 | 1/2011 | Panther et al. |
| 2011/0110550 | A1* | 5/2011 | Bharatan ..... H04R 1/28 381/355 |
| 2012/0082317 | A1 | 4/2012 | Pance et al. |
| 2012/0177237 | A1 | 7/2012 | Shukla et al. |
| 2012/0250928 | A1 | 10/2012 | Pance et al. |
| 2012/0263019 | A1 | 10/2012 | Armstong-Muntner |
| 2013/0017738 | A1 | 1/2013 | Asakuma et al. |
| 2013/0051601 | A1 | 2/2013 | Hill et al. |
| 2013/0129122 | A1 | 5/2013 | Johnson et al. |
| 2013/0164999 | A1 | 6/2013 | Ge et al. |
| 2013/0223654 | A1* | 8/2013 | Dehe ..... B81B 3/0078 381/174 |
| 2013/0259281 | A1 | 10/2013 | Filson et al. |
| 2013/0280965 | A1 | 10/2013 | Kojyo |
| 2014/0064542 | A1* | 3/2014 | Bright ..... H04R 1/086 381/359 |
| 2014/0093113 | A1 | 4/2014 | Dix et al. |
| 2014/0105440 | A1* | 4/2014 | Mittleman ..... H04M 1/035 381/355 |
| 2014/0113478 | A1 | 4/2014 | Yeung et al. |
| 2014/0226826 | A1* | 8/2014 | Utterman ..... H04R 1/086 381/55 |
| 2014/0250657 | A1 | 9/2014 | Stanley et al. |
| 2015/0078611 | A1 | 3/2015 | Boozer et al. |

FOREIGN PATENT DOCUMENTS

| | | |
|---|---|---|
| GB | 2342802 | 4/2000 |
| JP | 2102905 | 4/1990 |
| JP | 2004153018 | 5/2004 |
| JP | 2006297828 | 11/2006 |
| WO | WO03/049494 | 6/2003 |
| WO | WO2004/025938 | 3/2004 |
| WO | WO2007/083894 | 7/2007 |
| WO | WO2008/153639 | 12/2008 |
| WO | WO2009/017280 | 2/2009 |
| WO | WO2011/057346 | 5/2011 |
| WO | WO2011/061483 | 5/2011 |

OTHER PUBLICATIONS

Pingali et al., "Audio-Visual Tracking for Natural Interactivity," Bell Laboratories, Lucent Technologies, pp. 373-382, Oct. 1999.

Blankenbach et al., "Bistable Electrowetting Displays," https://spie.org/x43687.xml, 3 pages, Jan. 3, 2011.

* cited by examiner

ACTIVE PROTECTION FOR ACOUSTIC DEVICE

TECHNICAL FIELD

This subject matter of this disclosure relates generally to acoustic components for electronic devices. In particular, the disclosure relates to microphones and other acoustically coupled components for mobile and handheld devices, tablet computers, personal computers, cellular phones, personal digital assistants, media players, and other portable and stationary electronics applications.

BACKGROUND

Modern consumer and specialty electronic devices utilize a range of different acoustically coupled audio components, including microphones, pickups, speakers, and emitters. Depending on application, acoustic devices such as these can be configured to provide a wide variety of different electronics functionality, including voice communications, voice control, audio recording, motion sensing, and media playback and development.

In general, acoustically coupled audio devices must be designed to withstand a range of input and sensitivity levels. This can be particularly relevent in handheld, mobile, and other portable electronics applications, which may be subject to a range of uncontrolled environmental effects including dropping, impact and shock.

To address these concerns, a variety of different acoustic protection technologies are available, including acoustic mesh, foam, grille and acoustic gasket-type components. In addition to providing acoustic shock protection, such devices can also be configured to address the problems of water intrusion, contamination, and other environmental effects.

At the same time, acoustic mesh-based components and similar foam, grille, and gasket technologies also introduce materials between the acoustic device and the acoustic field. These materials may impact sound quality, requiring design tradeoffs between the required level of acoustic protection and desired acoustic performance. These tradeoffs, moreover, are typically manifested differently in different audio frequency ranges, and across the relevant subsonic and ultrasonic bands. As a result, there is a continuous need for improved acoustic protection techniques for acoustically coupled audio devices, including, but not limited to, microphones, speakers, pickups, emitters and other acoustic components on mobile, portable and handheld computing devices, and in other consumer and specialty electronics applications.

SUMMARY

This disclosure relates to electronic devices having acoustically coupled components, and methods of operating the devices. In various examples and embodiments, the devices may include a housing having an acoustic passage, an acoustic component coupled to an exterior of the device via the acoustic passage, and a mechanism operable to close the acoustic passage between the acoustic device and the housing. The mechanism may be actuated to close the acoustic passage in response to a control signal, where the control signal is indicative of a pressure differential that is transmitted, may be transmitted, or is transmittable from the exterior of the device to the acoustic component, propagating along the acoustic passage.

Depending on application, the control signal may comprise feedback (or a feedback signal) generated by the acoustic component, as indicative of the pressure differential transmitted from the exterior of the device to the acoustic component. The device may also include a controller in signal communication with the acoustic component and the actuator mechanism, where the controller is configured to generate the control signal based on the transmitted pressure differential.

In additional examples, the device may include a motion sensor in signal communication with the actuated mechanism or controller, or both, operable to generate a sensor signal indicative of motion of the device. Thus the control signal may also be indicative of the pressure differential as transmittable to the acoustic component, based on the motion of the device, for example where the motion sensor signal serves as a predictor or initial indicator of an impact or air burst event.

Depending on configuration, the motion sensor may comprise an accelerometer, and the controller can be further configured to generate the control signal based on an orientation of the device, as defined by the sensor signal from the accelerometer. Alternatively, a gyro sensor or gyroscope device may be used, or another motion sensitive device such as magnetometer or magnetic field indicator.

Depending on configuration, the device housing may include a cover glass, in which the acoustic passage can be defined. The acoustic component itself may comprise a microphone coupled to the exterior device via the acoustic passage in the cover glass, or a pickup, speaker, emitter, or other acoustically coupled component.

The actuator (or actuated mechanism) can utilize a solenoid or other electromagnetic actuator operable to close the acoustic passage by operation of a shutter or valve. In other designs, a microelectricalmechanical (MEMs) system or solid state actuator can be used, for example where the acoustic aperture is defined through the MEMs device or solid state actuator chip.

In additional applications, an electronic device may include a housing with an acoustic port, an acoustic device within the housing, and an actuator operable to close the acoustic port. The acoustic port may provide an acoustic coupling between the acoustic device and the device exterior, through the housing and acoustic port, and the actuator can be configured to open and close the port so, that the acoustic coupling is reduced. For example, the actuator may be operable to close the port in response to a control signal indicative of a pressure differential, where the pressure differential is transmitted or transmittable from the exterior of the housing through the acoustic port to the acoustic device.

In particular examples of the device, the housing may include a cover glass, for example a front glass, a back glass, or both. The acoustic device can include a microphone, with acoustic coupling to the exterior defined through the acoustic port in the cover glass. Alternatively, a pickup, speaker, emitter, or other acoustically coupled component may be utilized.

The electronic device can also include a controller in signal communication with the acoustic device and the actuator, where the controller is operable to generate the command signal based on feedback from the acoustic device. The feedback (or feedback signal), for example, may be indicative of the pressure differential transmitted from the exterior of the device through the acoustic port.

A motion sensor may be provided in signal communication with the controller, in order to provide a sensor signal indicative of motion of the device. The controller may be operable to generate the command signal based on the sensor signal from the motion sensor, so that the command signal is indicative of the pressure differential as (potentially) transmittable through the acoustic port, based on the motion of the device. Alternatively, the command signal may be indicative of the pressure differential as (actually) transmitted through the acoustic port, either utilizing the feedback signal or the motion sensor signal, where the motion sensor signal is indicative of motion preceding or accompanying a drop, impact, air burst, or acoustic shock event.

Methods of operating such portable electronic devices include generating an audio signal with an acoustically coupled component or acoustic device, where the acoustic device or component is coupled to an exterior acoustic field via an acoustic passage passing through the device housing. The acoustic passage may be opened between the acoustic device and the device housing, so that the audio signal is related to the acoustic field, for example by sampling the field with a microphone or pickup, or by generating the field with a microphone or emitter.

A control signal can be generated based on a pressure differential that is transmittable or transmitted through the acoustic passage, from exterior of the housing to the acoustic device. In operation of the device, the acoustic passage may be closed based on the control signal, for example between the acoustic device and the housing, so that the coupling to the external acoustic field is reduced, and the acoustic device is substantially or at least partially isolated from the pressure differential.

Depending on application, the audio signal may thus be generated as indicative of the external acoustic field, for example using a microphone or emitter, and the control signal may be based on the audio signal, as indicative of the pressure differential being over a threshold. Alternatively, the audio signal may generate the external acoustic field, for example using a speaker or emitter.

In addition, a sensor signal indicative of motion of the portable electronic device can also be generated. The control signal can be based at least in part on such as sensor signal, as indicative of the pressure differential transmittable through the acoustic passage based on the motion of the device, for example by signaling an incipient drop, impact, or air burst event, or the onset of such an event.

DETAILED DESCRIPTION

Figure 1A:
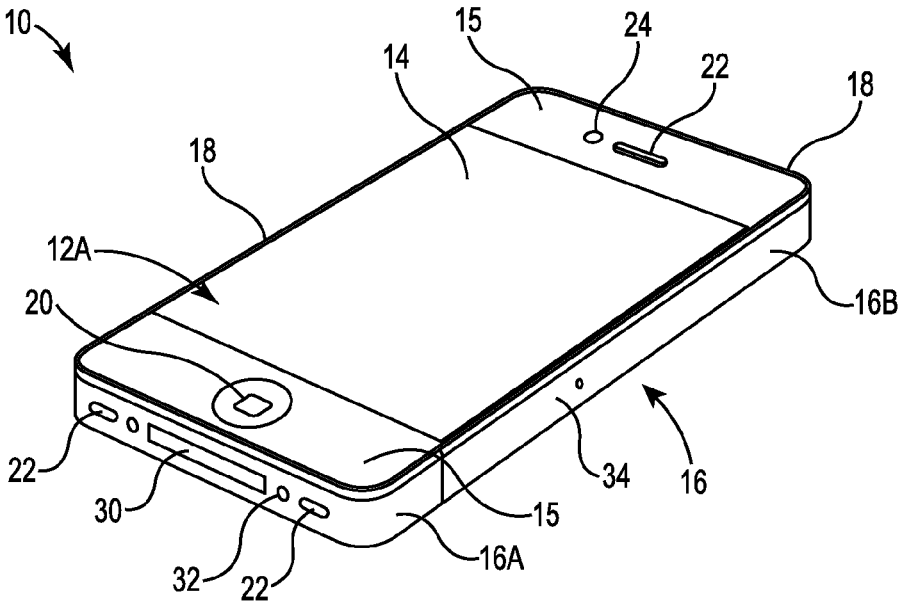
FIG. 1A is a front perspective view of an electronic device, in a communications embodiment, with an active protection mechanism for acoustically coupled components.
Figure 1B:
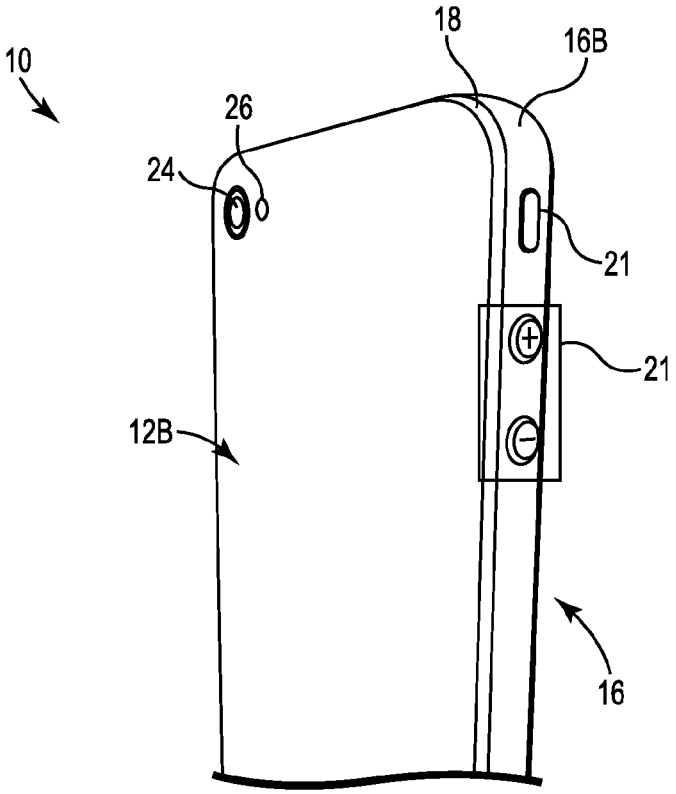
FIG. 1B is a rear perspective view of the device in FIG. 1A.

FIG. 1A is a perspective view of electronic device 10, in a communications embodiment, for example a portable phone or digital assistant. FIG. 1A is a front view of device 10, showing front cover (or cover glass) 12A. FIG. 1B is an alternate perspective view of device 10, showing rear cover (or cover glass) 12B. In this particular example, display window 14 is defined in front cover glass 12A, for example between opaque display frame or border 15.

In assembling device 10, front and back cover glass components 12A and 12B can be attached to housing 16, for example using a bezel or frame assembly 18 to couple front and back covers 12A and 12B between bottom and top portions 16A and 16B of housing assembly 16. A variety of mechanical, adhesive and other attachment techniques may be used. Depending on configuration, electronics device or assembly 10 may also accommodate one or more control mechanisms 20, acoustic devices 22, and cameras or other accessories 24.

Various acoustic devices and components 22 within device 10 can be coupled to the external acoustic field via acoustic ports and apertures in front glass 12A, back glass 12B, and housing 16. Acoustic devices 22 can also be provided with an active acoustic protection system, as described herein, in order to protect sensitive audio components in the event of an air burst, overpressure or underpressure event, for example when device 10 is dropped or subject to impact, as described below.

Additional control and accessory features may also be provided with device 10, for example volume button and mute switch mechanisms 21 in top portion 16B of housing 16, as shown in FIG. 1B. Device 10 may also include additional audio and acoustic features, including, but not limited to, speakers, microphones, pickups and emitters 22, and a variety of lighting or indicator features 26 (e.g., a flash unit, light emitting diode, or other indicator or illumination device).

Housing 16 and frame 18 are typically formed of a metal and other suitable structural materials, for example aluminum or stainless steel, or a durable plastic or composite material. Front and back cover components 12A and 12B are typically formed of a glass or crystalline material, or from a metal or a durable plastic polymer or composite. The terms cover and cover glass may thus be used interchangeably herein, without loss of generality and regardless of material composition, unless otherwise specified.

As shown in FIGS. 1A and 1B, cover components 12A and 12B, housing 16 and frame 18 can also accommodate additional audio and accessory features, including, but not limited to, additional speakers, microphones, and other acoustic components 22, connector apertures 30 for power and data communications, mechanical fasteners 32, and access ports 34 (e.g., for a subscriber identity module, flash memory device, or other internal component). Electronic device 10 is thus adaptable to a range of different stationary, mobile and portable device configurations, including, but not limited to, digital assistants, media players, and personal or tablet computing applications, as described herein.

Figure 2A:
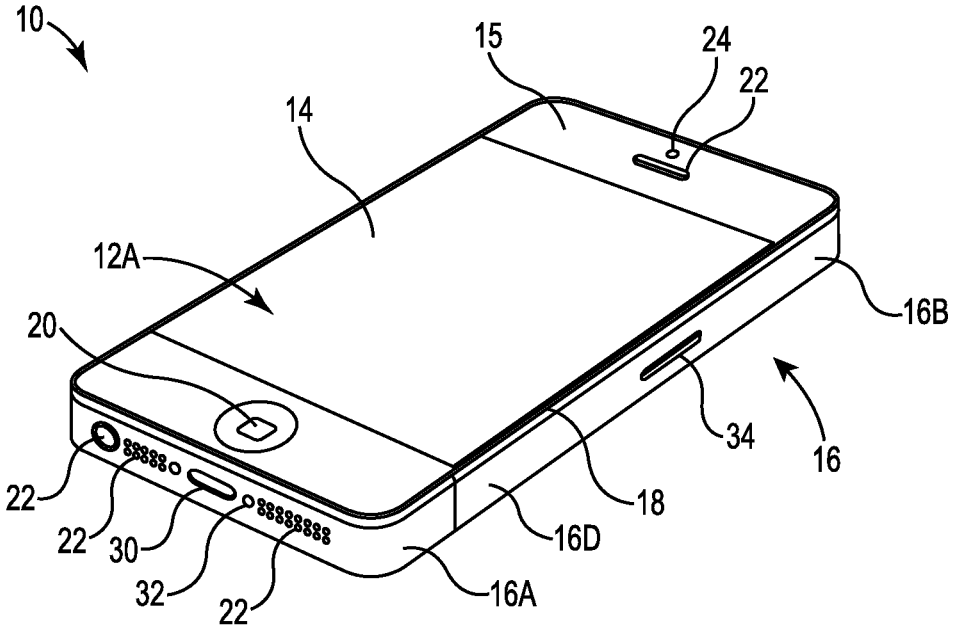
FIG. 2A is a front perspective view of the electronic device, in an alternate configuration.
Figure 2B:
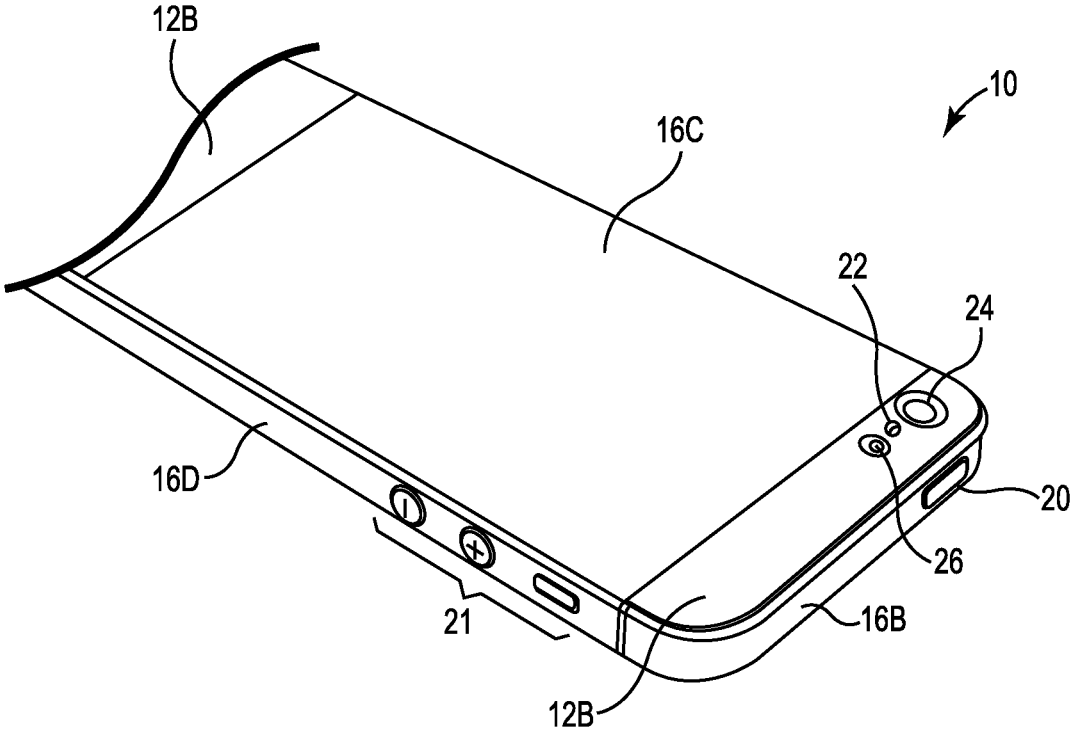
FIG. 2B is a rear perspective view of the device in FIG. 2A.

FIG. 2A is a front view of electronic device 10 in an alternate configuration, for example an advanced mobile device or smartphone. As shown in FIG. 2A, speakers, microphones and other audio components 22 can be acoustically coupled through ports or apertures in front glass 12A, and bottom portion 16A of housing 16. FIG. 2B is a back view of device 10, showing back glass 12B as two separate inlay or inset components, which may also accommodate one or more acoustically coupled audio components 22.

As shown in FIGS. 2A and 2B, housing 16 can be provided in a multi-piece beveled configuration, with bottom housing 16A, top housing 16B, and middle plate 16C. Middle plate 16C may extend across the back of device 10, between back glass insets 12B, forming side housing portions 16D between top and bottom housings 16A and 16B. Device 10 can also accommodate a range of different control buttons 20 and switches 21, for example a hold button mechanism 20 in top housing 16B, along with various cameras and other accessory features 24, 26, 30, and 32, as described above.

Figure 3A:
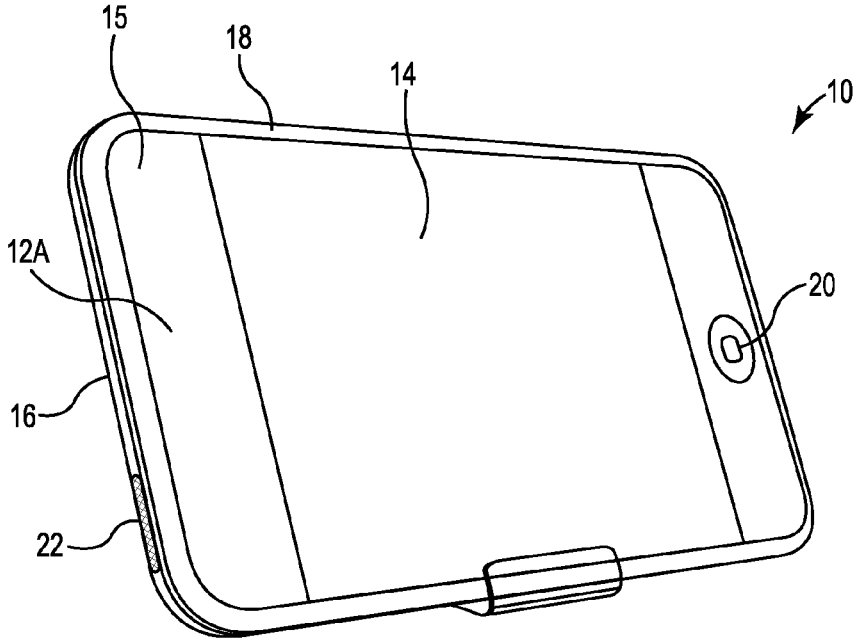
FIG. 3A is a front view of the electronic device, in a media player configuration.

FIG. 3A is a front view of electronic device 10, in a media player embodiment, showing display window 14 within border 15 on front glass 12A. In this particular example, a home button or other control mechanism 20 may be provided in front glass 12A, with a speaker or other acoustic device 22 in the side portion of housing 16. As illustrated by FIG. 3A, the aspect ratio of device 10 varies, and the horizontal and vertical orientations may be arbitrary. Thus, the various top, bottom, and side designations of the different components of device 10 may be interchanged without loss of generality, unless otherwise specified.

In one particular configuration, for example, housing 16 may have a substantially unitary construction, formed together with the back cover of device 10, and device 10 may be rotated freely in operation. One or both of housing 16 and frame 18 can also be formed of a plastic or other durable polymer material, or using a combination of metal, polymer, plastic and composite materials, and front glass 12A can be attached to housing 16 via adhesive coupling to frame 18.

Figure 3B:
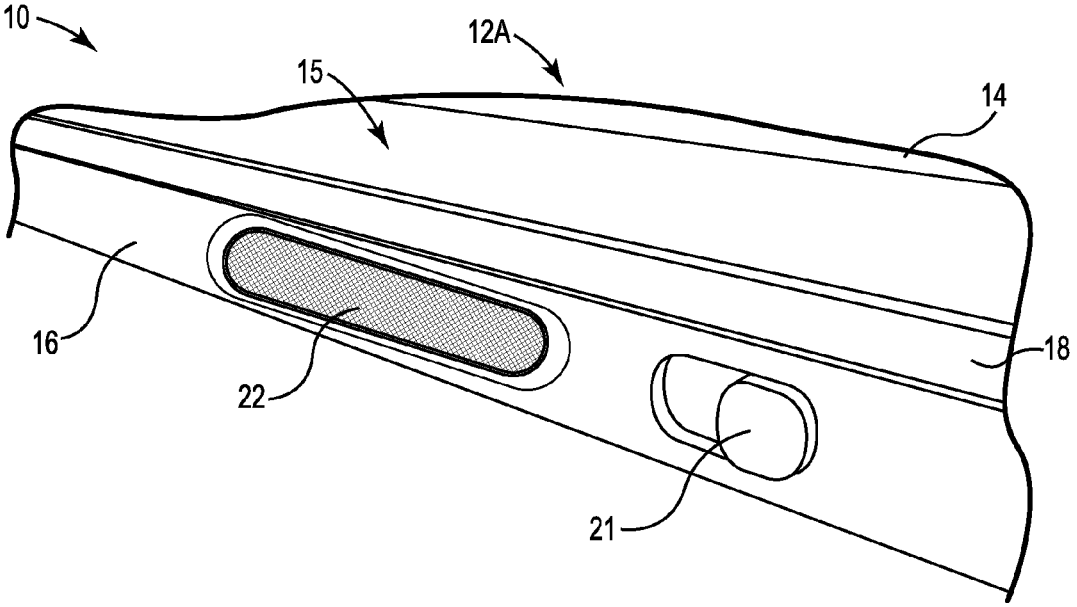
FIG. 3B is a perspective view of the electronic device, in a tablet computer configuration.

FIG. 3B is a perspective (corner) view of electronic device 10, in a computer embodiment, for example a tablet computer, pad computer, or other hand-held computing device, or a computer monitor or display. Front glass 12A accommodates display window 14 within border 15, as described above. One or more control mechanisms 21 and acoustic devices 22 are provided in the top, bottom or side portions of housing 16. As shown in FIG. 3B, housing 16 may be coupled to front glass 12A with a beveled frame assembly 18, or utilizing an internal bezel groove, for example as provided in either housing 16 or frame 18.

Figure 4:
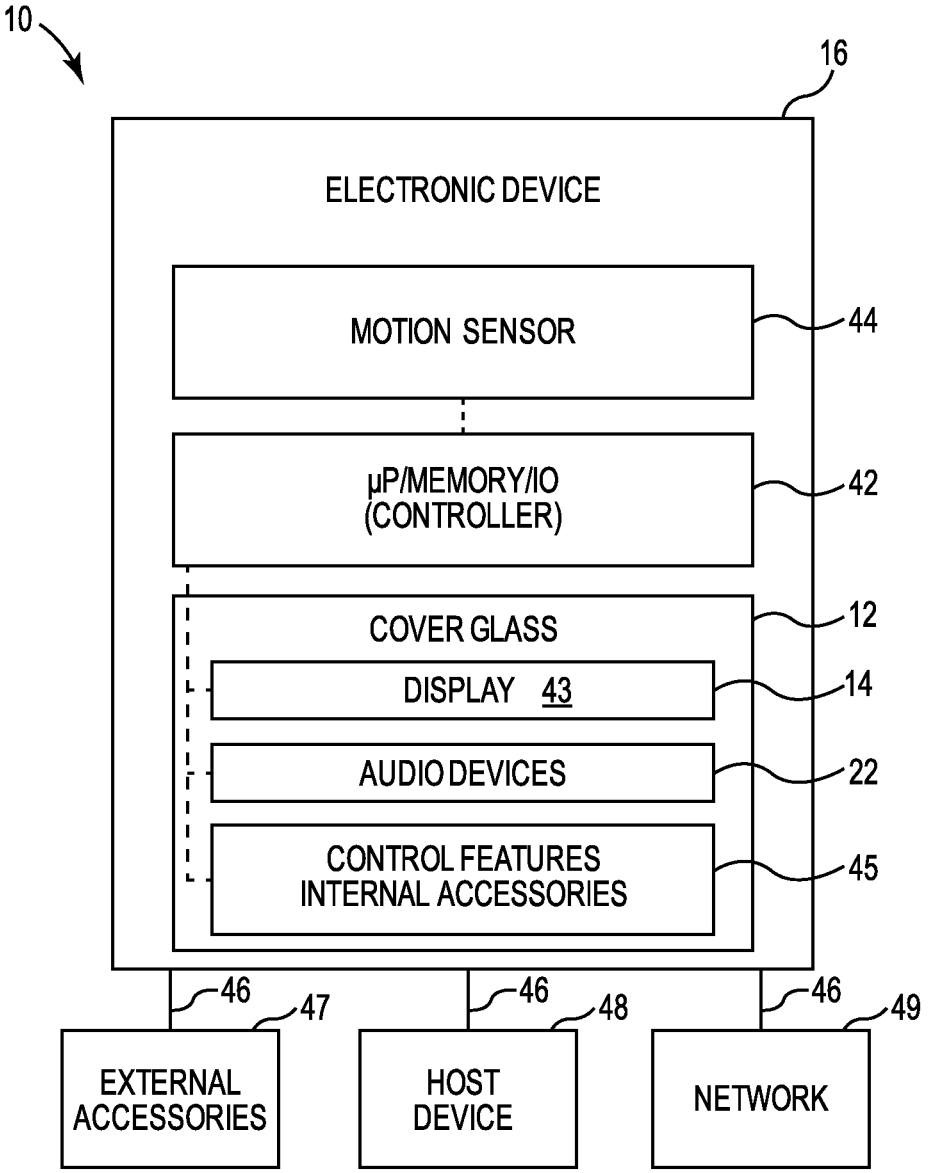
FIG. 4 is a block diagram illustrating internal and external components of the electronic device.

FIG. 4 is a block diagram illustrating various internal and external components of electronic device 10, including controller 42, display 43 within display window 14, accelerometer or other motion sensor 44, and internal accessories and control features 45. Hard-wired or wireless communication connections 46 may also be provided, in order to support various external accessories 47, host devices 48, and networks 49. One or more acoustic devices or acoustically coupled components 22 may be provided within cover 16 or cover glass 12, for example in the top, bottom, and side housing portions, or in the front and rear cover glass components 12A and 12B, as described above.

Device 10 encompasses a range of different portable and stationary electronic applications, as in FIGS. 3A-3B, as well as hybrid devices such as mobile telephones with media player capabilities, game players, remote global positioning and telecommunications devices, laptop, desktop, notebook, handheld and ultraportable computer devices, and other portable and stationary electronic devices 10. Depending on embodiment, cover glass 12 may be configured as one or more of a front glass 12A, back glass 12B, or a specialty (e.g., camera or lens) cover glass, and control/accessory features 45 may include one or more control mechanisms 20 and 21, cameras and other accessories 24, and indicator or illumination features 26, as described above.

Additional sensor components may also be provided, for example an accelerometer, magnetic sensor or other position or motion sensor 44. Depending on application, device 10 may also incorporate a global positioning system (GPS) and haptic feedback mechanisms such as a vibration motor or actuator. Available external accessories 47 include headphones, speakers, displays, and other external components.

As shown in FIG. 4, controller 42 is electronically coupled to display 43, accelerometer or other motion sensor 44, control/accessory features 45, and one or more acoustic components 22. Controller 42 includes various microprocessor (μp) and memory components, which can be configured to control device 10 by executing a combination of operating system and application software, in order to provide functionality including, but not limited to, voice communications, voice control, media playback and development, internet browsing, email, messaging, gaming, security, transactions, navigation, and personal assistant functions. Control components 42 may also include communication interfaces and other input-output (IO) devices configured to support connections 46 with external accessories 47, host devices 48, and network systems 49, including hard-wired, wireless, audio, visual, infrared (IR), and radio frequency (RF) communications.

As the industry advances, electronic devices 10 are subject to ever-greater acoustic performance requirements. In response, the number and sensitivity of microphones and other acoustic devices 22 on device 10 tends to increase. In smartphone and mobile device applications, for example, multiple microphone and speaker configurations can be integral to offering optimal audio performance and response, and acoustic device positioning may have a substantial impact of advanced techniques such as beam forming for noise cancellation, voice recognition, and overall audio quality.

To address these design demands, microphones and other acoustic devices 22 can be placed on both user (front) and back-side surfaces of cover glass 12, and in housing 16 along the perimeter of device 10. Where sensitive audio components are placed on the substantially flat or planer front glass (user side) and back glass (back side) surfaces, however, there is a potential for air burst passage through the acoustic port, for example in real-life mobile device events such as a face drop or back drop onto a flat surface.

In particular, drop and shock events may result in a substantial overpressure or underpressure across acoustic ports located on the front or back surfaces of cover glass 12, presenting a risk of possible damage to microphone diaphragms, speaker cones, and other sensitive acoustical-mechanical components. Acoustic devices 22 in housing 16 may also be subject to damage from external effects, for example side or perimeter impacts and high-intensity external acoustic fields, for example loud music and other sources of high amplitude acoustic waves or shocks.

Traditionally, acoustic meshes are placed in front of the microphone ports, both to protect from debris and to provide damping and resistance in the event of an air burst or other acoustic shock or impact event. Acoustic meshes and other passive devices, however, are limited in effectiveness, because substantial pressure waves and acoustic energy may still be able to pass through the porous mesh, foam, or grille materials, particularly in large air burst and acoustic shock events.

To address these design concerns, and increase the service life of individual acoustic components 22, device 10 may utilize an active mechanical or electromechanical system to sense the onset of an impending drop or shock event, for example as characterized by an increase or decrease in pressure across the acoustic aperture, or based on motion of the device. In response to such an event, or its onset, the active acoustic protection system is operable to actuate a mechanism to close the acoustic port, providing a mechanical seal across the corresponding acoustic aperture(s) and passage(s). Closing the acoustic passage substantially reduces the overpressure or underpressure experienced by acoustic device 22, lowering the risk of damage and increasing service life, as described below.

Figure 5A:
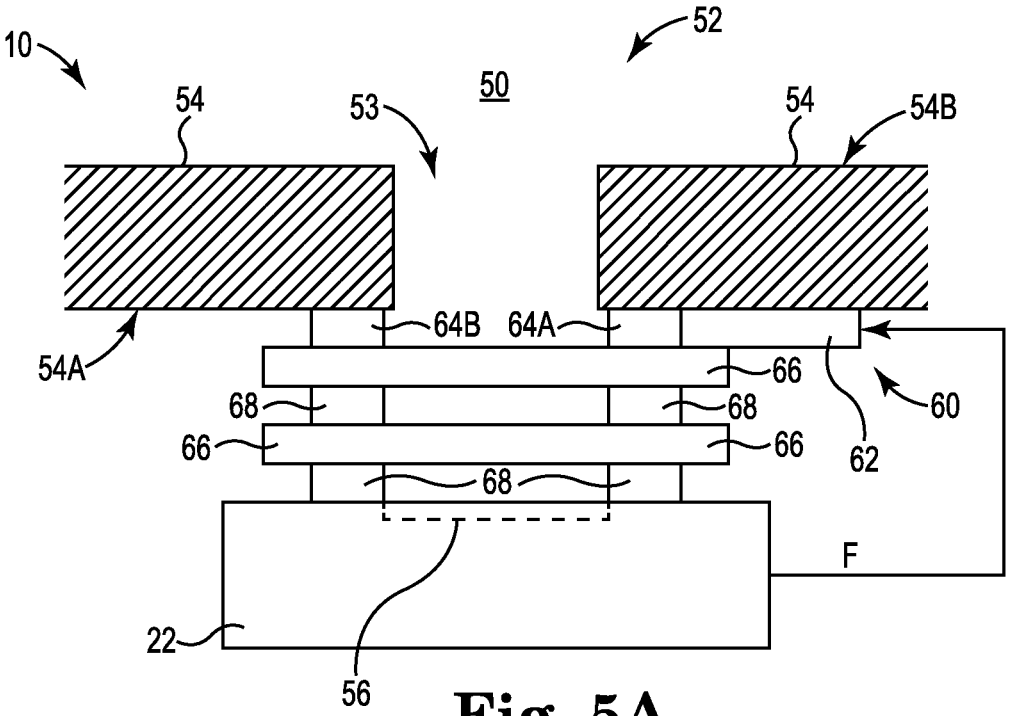
FIG. 5A is a schematic illustration of an acoustically coupled component for the electronic device, showing the active protection mechanism in an open configuration.

FIG. 5A is a schematic illustration of acoustic device 22, for example a microphone, speaker, emitter, pickup or other acoustically coupled audio component for electronic device 10, as described above, or another consumer-based or specialty electronics application. As shown in FIG. 5A, acoustic device 22 is coupled to acoustic field 50 through an acoustic aperture or port 52 in a cover glass or other housing component 54, for example in front or back cover glass 12A or 12B of device 10, or in device housing 16.

Acoustic port 52 may include one or more holes or openings 53 in housing 54, for example a microphone or speaker port 52 defined by one or more suitable acoustic openings or passages 53. The number of individual apertures or passages 53 may be one or more, and may vary from application to application, depending on the desired acoustic performance of electronic device 10, and the corresponding operational characteristics of acoustically coupled component 22.

Housing structure 54 may comprise a substantially flat or planar cover glass or cover component 12A or 12B, as described above, or other suitable housing component 16. Acoustic apertures 53 extend from the interior to the exterior of housing 54, coupling acoustic device 22 on the inside of device 10 to acoustic field 50 on the outside of device 10. In mobile device and other portable electronics applications, for example, acoustic aperture(s) 53 may be exposed to air on outside surface 54B of device housing 54, in order to couple a microphone diaphragm, speaker cone, pickup, emitter, or other acoustical-mechanical element 56 of acoustic device 22 to a substantially freely propagating acoustic field 50 on the exterior of device 10.

To protect acoustic device 22 from the effects of overpressure, underpressure, air burst, and other drop, shock, or impact related events, active acoustic protection mechanism 60 is provided, for example between acoustic device 22 and inside surface 54A of housing 54, as shown in FIG. 5A, opposite outside surface 54B of housing 54, and proximate acoustic port 52. In one particular configuration, for example, mechanism 60 may include an actuator 62 for operating one or more valve or shutter components 64A and 64B, in response a control signal based on pressure or feedback signal F from acoustic device 22.

In operation of such a mechanism 60, actuator 62 is actuated to position one or more valve members or shutter components 64A or 64B across acoustic port 52, in order to close or seal off acoustic aperture(s) or passage(s) 53. With mechanism 60 in the actuated or closed position (see FIG. 5B), pressure differentials across acoustic port 52 are dampened, reflected, or otherwise reduced in amplitude along acoustic passage(s) 53, between housing 54 and acoustic device 22. As a result, energy transfer to device 22 can be substantially reduced and acoustic device 22 can be substantially or at least partially isolated from external acoustic field 50, decreasing the risk of damage to sensitive components including microphone diaphragms, speaker cones, and other acoustical-mechanical elements 56.

Protection mechanism 60 may also incorporate a number of passive acoustic and environmental protection features, including one or more acoustic mesh, grille, foam, or screen components 66, and various acoustic baffles, gaskets, and other active or passive acoustic elements 68. These various components may be assembled via a variety of techniques, for example via adhesive or mechanical coupling to one or both of acoustic device 22 and inner surface 54A of housing 54, inside acoustic port 52. Alternatively, one or more mesh, grille, baffle or gasket components may also be provided on exterior surface 54B of housing 54, for example over or around acoustic port 52.

Figure 5B:
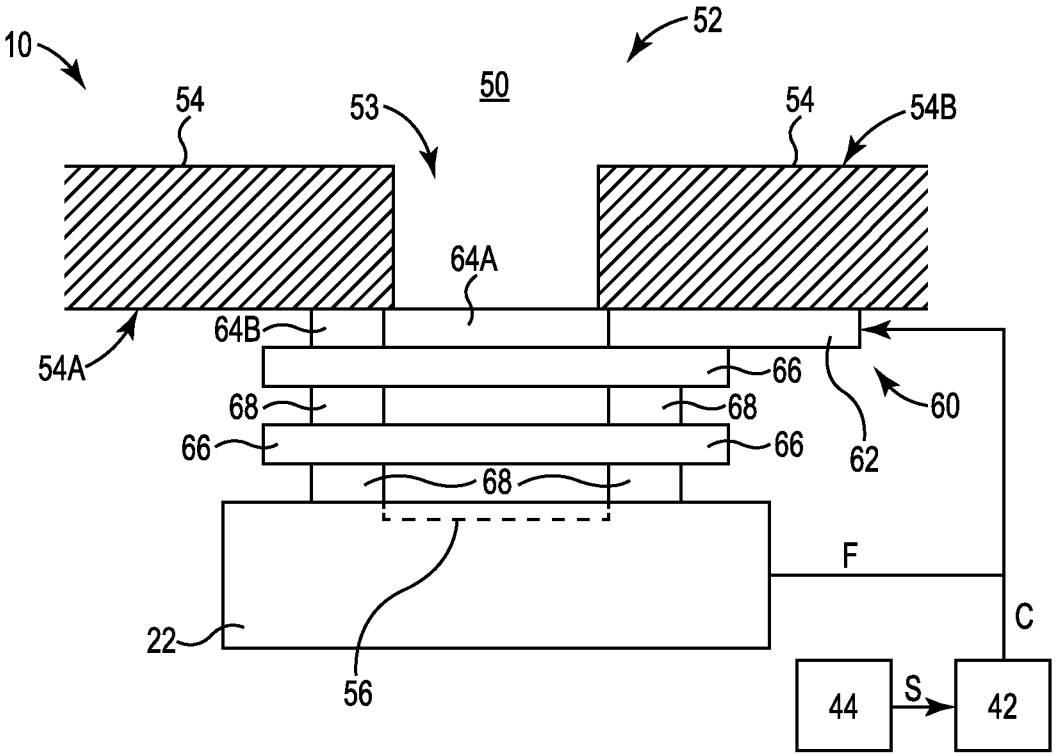
FIG. 5B is a schematic illustration of the acoustically coupled component for the electronic device, showing the active protection mechanism in a closed configuration.

FIG. 5B is a schematic illustration of acoustic device or component 22, with active protection mechanism 60 in an actuated or closed position. As shown in FIG. 5B, actuator 62 is operable to position and actuated valve component or shutter member 64A against stationary valve member or stop 64B, for example in response to command signal C from controller 42, in order to close acoustic port 52 and seal off acoustic aperture(s) or passage(s) 53.

Active acoustic protection mechanism 60 may also operate actuator 62 in response to a sound level or pressure feedback signal F from acoustic device 22, as described above, or based on an impact, drop or shock event indicated by sensor signal S from an accelerometer, gyroscope, or other motion sensor device 44. In these applications, controller 42 is operable to generate a command or control signal C based on feedback signal F, sensor signal S, or a combination thereof.

Thus, mechanism 60 is operable to protect sensitive components 56 of acoustic device 22 from a range of different air burst, overpressure, underpressure and shock effects, whether due to impact or based on ambient noise or pressure levels, for example when device 10 is dropped, or placed in close proximity to a loudspeaker or other noise source. Mechanism 60 is also operable to protect acoustic device 22 from other environmental effects, for example wind shear, or when a user or other person blows into or across acoustic port 52 or aperture(s) 53.

Actuator 62 and shutter or valve components 64A and 64B may thus vary in configuration, depending upon the desired response of mechanism 60. In one configuration, for example, mechanism 60 may be configured to seal acoustic port 52 and aperture(s) or passage(s) 53 utilizing a solenoid driven plunger-type actuator assembly 62, with one or more corresponding valve or shutter members 64A and 64B. In another example, actuator 62 may comprise a solenoid or other linear actuating device, configured to position one or more valve or shutter components 64A across acoustic aperture(s) or passages(s) 53, in a closed or sealing arrangement with respect to one or more stationary shutter or valve stop components 64B, closing off acoustic port 52.

Alternatively, an electromagnetic chip or solid state actuator mechanism 62 may be used, in order to seal one or more acoustic apertures or openings 53 formed within the chip body, between actuated members 64A and 64B. Mechanism 60 may also utilize a MEMs type actuator 62 with flappers or other actuated members 64A or 64B to seal acoustic port 52 and aperture(s) or passage(s) 53, or a gear drive on a linear or rotary stepper motor, which actuates one or more arm or cam components 64A and 64B to block acoustic port 52 and aperture(s) 53. In additional configurations, actuator 62 may utilize any of a rotational actuator, gear drive, or lever actuator, in order to position one or more shutter, cam, or valve components 64A and 64B across acoustic port 52 and aperture(s) 53 by rotation, linear actuation, or a combination thereof. Additional actuators 62 include suitable electric, magnetic, electromagnetic, mechanical, electromechanical, and piezoelectric mechanisms, in combination with a range of different sliding, rotational, and spring bias, shutter, stop, and iris-type components 64A and 64B.

In the particular example of a front or back drop event, these various configurations of mechanism 60 are operable to protect acoustic device 22 from a pressure wave or burst of air that can fill the microphone aperture or other acoustic port 52, as defined in a front or back glass cover portion of housing 54. Microphone or acoustic device 22 can itself be used to detect the acoustic response from such an air burst, acoustic shock, or overpressure event, based on feedback signal F.

A software threshold can be applied to feedback signal F, based on test data, in order to generate a control signal or command for triggering mechanism 60 to activate actuator 62. Actuator 62 operates to seal acoustic port 52, for example by positioning one or more shutter or valve members 64A and 64B across acoustic apertures or passages 53. Thus, mechanism 60 operates to seal acoustic port 52 from the environment outside device 10, substantially or at least partially isolating device 22 from the pressure wave and external acoustic field 50.

To detect a drop event or other sudden acceleration, sensor signal S may also be utilized. Sensor signal S may be generated, for example, from an accelerometer, gyroscope or other motion sensor 44. Based on test data, a software threshold can also be applied to sensor signal S, in order to detect an imminent or ongoing drop or air burst event.

In these applications, sensor signal S can also by utilized to detect the orientation of the product, and controller 42 can adapt control signal C according. For example, if a user drops device 10 onto a flat surface or other impact area from a particular threshold distance, for example 1 meter, motion sensor 44 can measure the device response and controller 42 can issue command signal C, directing mechanism 60 to form a mechanical seal across acoustic port 52 and seal acoustic aperture(s) 53 by operation of actuator 62 and or more shutter or valve members 64A and 64B.

Sensor signals S from motion sensor 44 can also be utilized to detect the orientation of device 10, so that controller 42 can issue direct command signal C to a front side or back side mechanism 60, accordingly, when the corresponding front or back side of device 10 is facing the ground or impact surface. Alternatively, one or more active acoustic protection mechanisms 60 may be configured to close off a number of different acoustic ports 52 and apertures 53 in device 10 based on any combination of suitable feedback signals F and motion sensor signal S, either in dependence on the signal source or independent of the signal source, and either dependent on or independent of the particular orientation and state of motion of device 10.

Figure 6:
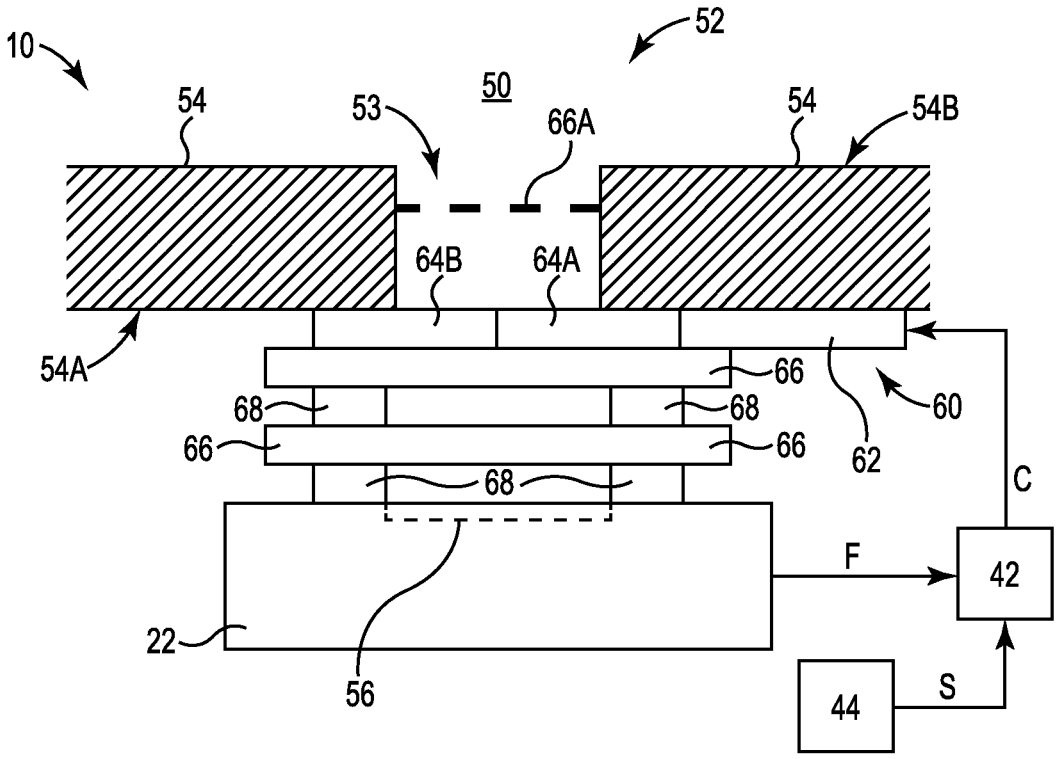
FIG. 6 is schematic illustration of the acoustic component, in an alternate configuration.

FIG. 6 is a schematic illustration of acoustic device 22, in an alternate configuration with acoustic port 52 divided into multiple individual acoustic apertures or passages 53, for example using acoustic grille (or grill) member 66A. One or more acoustic grille members 66A may be provided on or adjacent inner surface 54A or outer surface 54B or housing 54, or within housing 54, as shown in FIG. 6. Additional grille, mesh, foam, and acoustic screen components 66 may also be provided along the interior portion of acoustic passage(s) 53, between housing 54 and acoustic device 22, as described above.

In the alternate configuration of FIG. 6, active acoustic protection mechanism 60 includes one or more actuators 62 operable to position two or more actuated shutter or valve components 64A and 64B, in order to close off acoustic port 52 and seal acoustic apertures of passages 53. Alternatively, one or more shutter or valve components 64A and 64B may be stationary, and one or more other components 64A and 64B may be actuated, for example using a linear or rotational actuator 62 or other mechanism, as described above with respect to FIGS. 5A and 5B.

Overall, active acoustic protection mechanism 60 is operable to utilize both microphone data and other feedback signals F from acoustic devices 22, as well as accelerometer, gyroscope and other motion sensor data and signals S, in order to detect events which may generate potentially damaging air bursts and other overpressure, underpressure, or shock conditions across acoustic port 52. In response to any such signal, mechanism 60 is operable to actuate one or more shutter or valve members 64A and 64B via an electromechanical, solid state or other actuator 62, creating a mechanical and acoustic seal between acoustic device 22 and the environment outside acoustic port 52. Mechanism 60 may also substantially or at least partially isolate sensitive diaphragms, speaker cones and other acoustically coupled components 56 from external acoustic field 50, reducing the acoustic coupling to substantially reflect or dampen pressure differentials and acoustic shocks that may be transmittable across acoustic port 52 and along acoustic passages or apertures 53 to acoustic device 22.

Thus, active acoustic protection mechanism 60 improves the reliability and service life of acoustically coupled components 22, making electronic device 10 more robust to the various real-life situations that are encountered in actual field use. In particular, mechanism 60 provides customers and other users with the ability to subject personal electronics devices 10 to a broad range of extreme use cases and conditions, in which device 10 provides more robust operation when exposed to a variety of different environmental and operational effects, including exposure of microphones and other acoustic devices 22 to air bursts and acoustic shocks.

Figure 7:
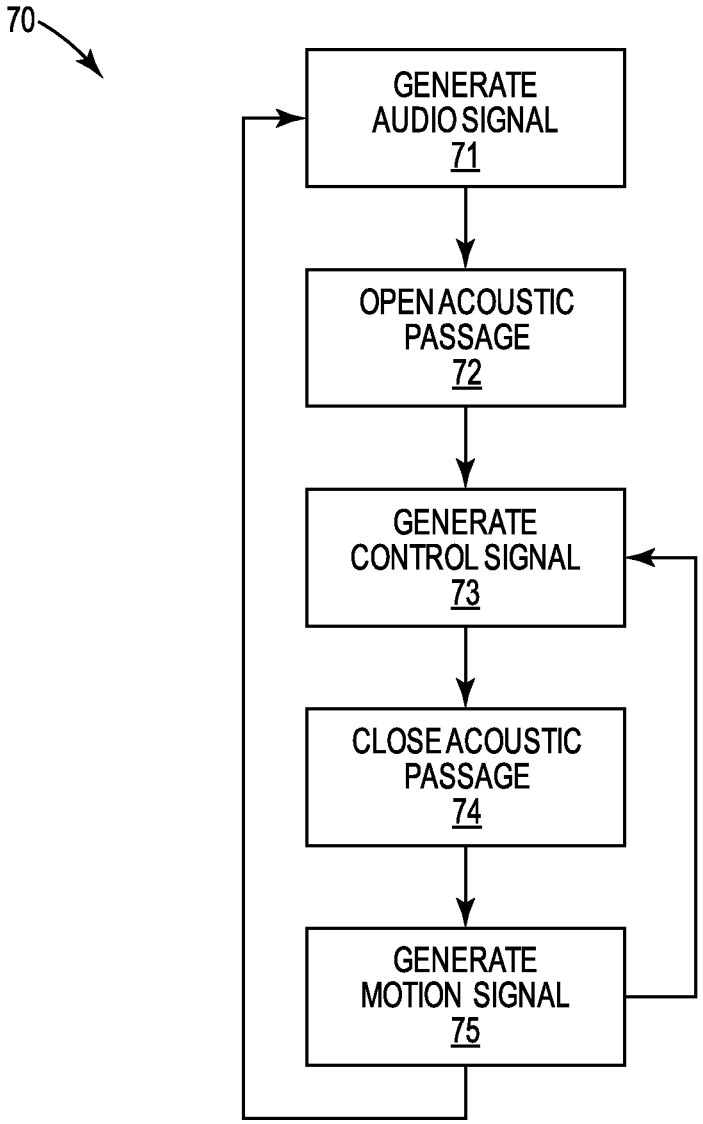
FIG. 7 is a block diagram of a method for operating the electronic device, in combination with an active acoustic protection mechanism.

FIG. 7 is a block diagram of method 70 for operating an electronic device, for example device 10 with active protection mechanism 60, as described above. Method 70 may include one or more steps including, but not limited to, generating an audio signal (step 71), opening an acoustic passage (step 72), generating a control signal (step 73), closing the acoustic passage (step 74), and generating a motion signal (step 75).

Generating the audio signal (step 71) may be performed with an acoustic device or audio component, for example a microphone, pickup, speaker or emitter coupled to the external acoustic field via an acoustic passage in the device housing. For example, the audio signal can be generated by a microphone or pickup, for example as an electronic signal indicative of the external acoustic field, propagating along the acoustic passage to the acoustic device. Alternatively, the audio signal can be generated by a speaker or emitter, for example as an audio frequency, ultrasonic or subsonic pressure wave that generates the external acoustic field by propagating through the housing along the acoustic passage, to the exterior of the device.

Opening the acoustic passage (step 72) may be performed with an actuator and shutter or valve mechanism, or any of the other actuated mechanisms described herein. The acoustic passage may be opened between the acoustic device and the housing, so that the audio signal is related to the external acoustic field. For example, the audio signal may characterize the external field by generating an electrical signal using a microphone or pickup, or the audio signal may generate the external acoustic field with a microphone or emitter, as described above. When the acoustic passage is open, damping and other losses are reduced along the acoustic passage, as compared to the closed configuration.

Generating a control signal (step 73) may be based on a pressure differential that is transmittable through the acoustic passage, from exterior of the housing to the acoustic element. Feedback signals can be generated not only by microphones and pickups, but also emitters and speakers, which are operable in both actively driven (audio generation) and passively driven (audio reception) modes.

Closing the acoustic passage (step 74) may be performed based on the control signal, so that the acoustic device is substantially isolated from the pressure differential. For example, the control signal may be based on a feedback signal from the acoustic device, as indicative of the pressure differential actually transmitted the acoustic passage from the outside of the housing to the acoustic device. In this mode of operation, the acoustic aperture can be closed off at the leading edge or onset of the pressure differential, for example when the feedback signal exceeds a particular threshold, in order to prevent damage due to the ensuing air burst or acoustic shock event.

A motion sensor signal may also be generated (step 75), for example using an accelerometer, gyro sensor, or other motion sensitive device, so that the sensor signal is indicative of motion of the portable electronic device, or of motion and orientation of the device. Thus, generating the control signal (step 73) may also be based on the motion sensor signal, as indicative of the pressure differential that is transmittable (or may be transmitted) through the acoustic passage, based on the motion of the device.

In this mode of operation, the acoustic aperture can be closed off before the actual air burst or acoustic shock event, for example based on a rotational or free fall signal from an accelerometer or gryo, or based on an impact, before the air bust or acoustic shock actually enters the acoustic passage. Alternatively, the acoustic aperture may be closed off at the onset of the event, as in the feedback based mode, in order to reduce the acoustic coupling and substantially isolate (or at least partially isolate) the acoustic device from the exterior of the device, and to reflect or dampen the differential pressure (overpressure or underpressure) wave before it propagates to the acoustic device.

While this invention has been described with reference to exemplary embodiments, it will be understood by those skilled in the art that various changes can be made and equivalents may be substituted for elements thereof, without departing from the spirit and scope of the invention. In addition, modifications may be made to adapt the teachings of the invention to particular situations and materials, without departing from the essential scope thereof. Thus, the invention is not limited to the particular examples that are disclosed herein, but encompasses all embodiments falling within the scope of the appended claims.

I claim:

1. A device comprising:

a housing surrounding one or more components of the device, the housing defining an acoustic passage;

an acoustic component contained within the housing, wherein the acoustic component generates an audible audio signal and is acoustically coupled to an exterior of the device via the acoustic passage; and an actuation mechanism operable to close the acoustic passage between the acoustic component and the housing in response to a control signal indicative of a pressure differential transmitted from the exterior of the device along the acoustic passage to the acoustic component.

2. The device of claim 1, wherein the control signal comprises a feedback signal generated by the acoustic component, the feedback signal indicative of the pressure differential as transmitted from the exterior of the device along the acoustic passage to the acoustic component.

3. The device of claim 1, further comprising a controller in signal communication with the actuation mechanism and the acoustic component, the controller configured to generate the control signal based on the pressure differential as transmitted to the acoustic component.

4. The device of claim 3, further comprising a motion sensor in signal communication with the controller and operable to generate a sensor signal indicative of motion of the device, wherein the control signal is indicative of the pressure differential as transmittable to the acoustic component based on the motion of the device.

5. The device of claim 4, wherein the motion sensor comprises an accelerometer.

6. The device of claim 5, wherein the controller is further configured to generate the control signal based on an orientation of the device, the orientation defined by the sensor signal from the accelerometer.

7. The device of claim 1, wherein the housing comprises a cover glass having the acoustic passage defined therein.

8. The device of claim 7, wherein the acoustic component comprises a speaker coupled to the exterior of the device through the acoustic passage in the cover glass.

9. The device of claim 1, wherein the actuation mechanism comprises an electromagnetic actuator operable to close the acoustic passage by actuation of a shutter or valve.

10. The device of claim 1, wherein the actuation mechanism comprises a microelectrical mechanical or solid state actuator having the acoustic aperture defined therein.

11. An electronic device comprising:

a housing defining an acoustic port;

an acoustic device within the housing, the acoustic device adapted to generate an audible audio signal and having an acoustic coupling to an exterior of the housing through the acoustic port; and an actuator configured to open and close the acoustic port, such that the acoustic coupling is substantially reduced when the acoustic port is closed;

wherein the actuator closes the acoustic port in response to a control signal indicative of sensed movement of the electronic device and a pressure differential transmittable from the exterior of the housing through the acoustic port to the acoustic device.

12. The electronic device of claim 11, wherein the housing comprises a cover glass having the acoustic port therein.

13. The electronic device of claim 12, wherein the acoustic device comprises a microphone having the acoustic coupling to the exterior of the housing through the acoustic port in the cover glass.

14. The electronic device of claim 11, further comprising a controller in signal communication with the acoustic device and the actuator, the controller operable to generate the command signal based on feedback from the acoustic device, wherein the feedback is indicative of the pressure differential as transmitted through the acoustic port.

15. The electronic device of claim 14, wherein the movement of the electronic device is determined by a motion sensor in signal communication with the controller.

16. A method comprising:

generating an audio signal with a speaker coupled to an external acoustic field via an acoustic passage in a housing of a portable electronic device;

opening the acoustic passage between the acoustic device and the housing such that the audio signal corresponds to the external acoustic field;

generating a control signal based on a pressure differential transmitted through the acoustic passage from the exterior of the housing to the acoustic device; and closing the acoustic passage such that the acoustic device is substantially isolated from the pressure differential when the pressure differential exceeds a threshold.

17. The method of claim 16, further comprising generating a sensor signal indicative of motion of the portable electronic device, wherein generating the control signal is based on the sensor signal as indicative of the pressure differential transmitted through the acoustic passage based on the motion of the portable electronic device.

18. The method of claim 16, wherein closing the acoustic passage comprises causing an actuation mechanism to move a shutter from a first position to a second position.

19. The method of claim 16, further comprising closing the acoustic passage based on detected movement of the portable electronic device.

20. The method of claim 16, wherein the movement of the portable electronic device is detected by an accelerometer.

* * * * *